US006113271A

United States Patent [19]

Scott et al.

[11] Patent Number: 6,113,271

[45] Date of Patent: Sep. 5, 2000

[54] RESEALABLE LABEL FLAP INCLUDING LABEL STOP

[75] Inventors: Barry M. Scott, West Bend; James F. Konicke, Muskego, both of Wis.

[73] Assignee: Prime Label & Screen, Inc., Pewaukee, Wis.

[21] Appl. No.: 09/266,393

[22] Filed: Mar. 11, 1999

[51] Int. Cl.[7] ..... B65D 65/26

[52] U.S. Cl. ..... 383/211; 40/630; 206/494; 220/359.3; 383/66; 383/203; 383/205; 428/212

[58] Field of Search ..... 383/203–205, 383/210, 211, 66, 109, 89; 206/494; 229/123.1, 123.3; 40/630, 638, 675, 594; 428/42.1, 41.1, 42.3, 212, 355 RA, 354, 343, 352, 914, 915; 220/359.2, 359.3

[56] References Cited

U.S. PATENT DOCUMENTS

| | | | |
|---|---|---|---|
| 4,008,851 | 2/1977 | Hirsch | 383/71 X |
| 4,526,405 | 7/1985 | Hattemer | 40/630 X |
| 4,552,269 | 11/1985 | Chang . | |
| 4,610,357 | 9/1986 | Nakamura . | |
| 4,616,470 | 10/1986 | Nakamura . | |
| 4,679,693 | 7/1987 | Forman | 383/203 |
| 4,739,879 | 4/1988 | Nakamura | 383/205 X |
| 4,840,270 | 6/1989 | Caputo et al. . | |
| 4,848,575 | 7/1989 | Nakamura et al. | 383/211 X |
| 4,863,064 | 9/1989 | Dailey, III | 206/494 X |
| 5,035,518 | 7/1991 | McClintock . | |
| 5,044,766 | 9/1991 | Schramer et al. | 383/89 |
| 5,222,766 | 6/1993 | Instance | 40/630 X |
| 5,725,311 | 3/1998 | Ponsi et al. . | |
| 5,855,434 | 1/1999 | Hagen | 383/89 |

FOREIGN PATENT DOCUMENTS

| | | | |
|---|---|---|---|
| 367092 | 5/1990 | European Pat. Off. | 229/123.3 |

*Primary Examiner*—Allan N. Shoap
*Assistant Examiner*—Robin A. Hylton
*Attorney, Agent, or Firm*—Andrus, Sceales, Starke & Sawall

[57] ABSTRACT

A resealable label flap including a label stop that bonds with a product package to prevent removal of the label flap from the product package. The label flap includes a base layer having a first adhesive applied to its bottom face surface. The first adhesive is a removable adhesive that allows the label flap to be repeatedly pealed and reapplied to the package body. The label flap further includes a top layer applied to the top face surface of the base layer. A portion of the top layer extends past the base layer to form a label stop for the label flap. The label stop of the label flap includes a second adhesive that permanently bonds with the package body to prevent the complete removal of the label flap from the package body.

12 Claims, 2 Drawing Sheets

FIG. 3
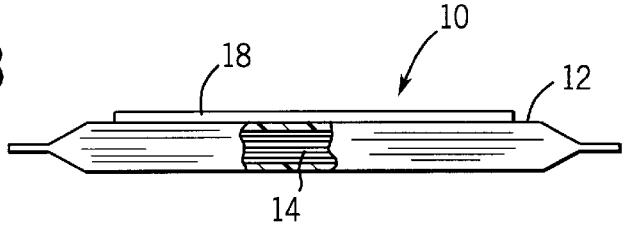
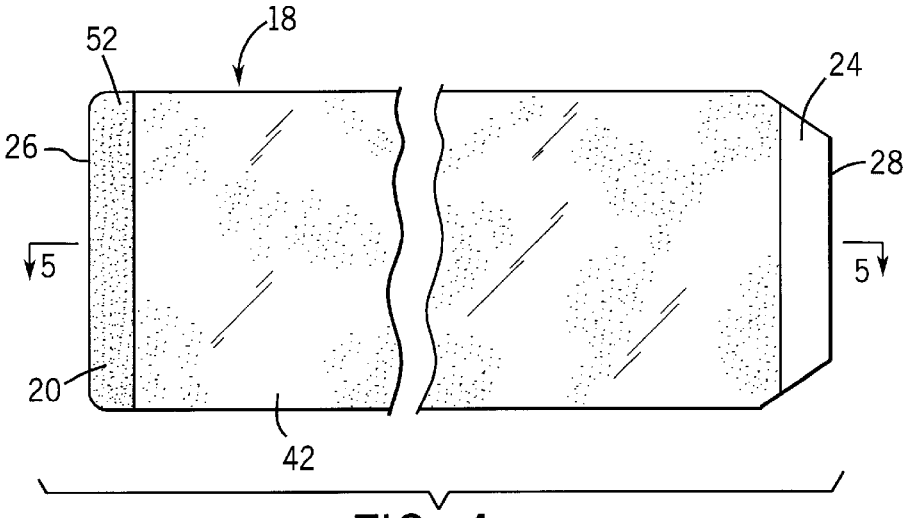
FIG. 4
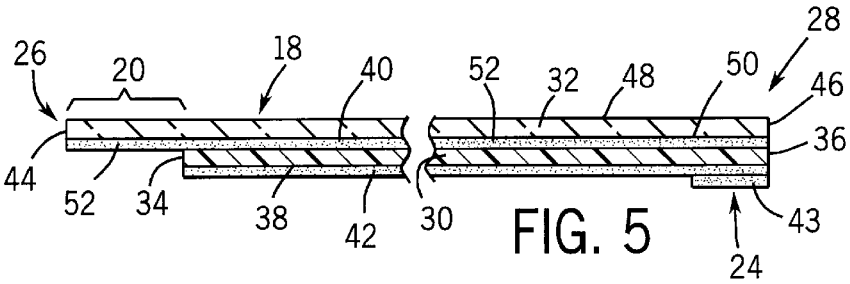
FIG. 5
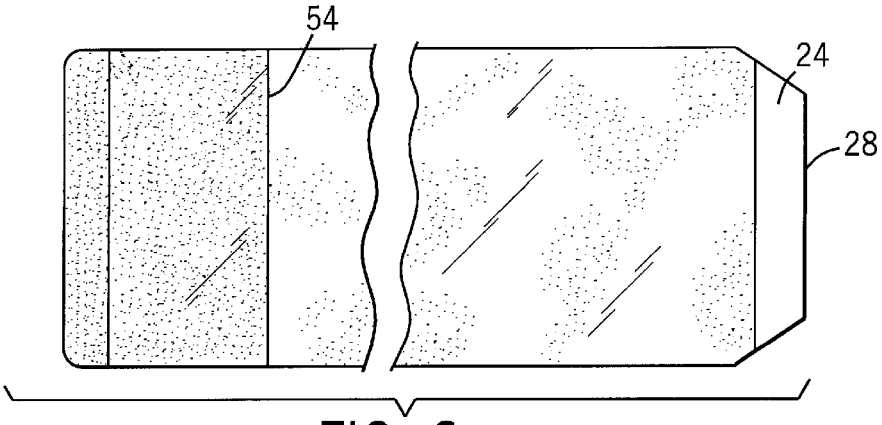
FIG. 6

RESEALABLE LABEL FLAP INCLUDING LABEL STOP

BACKGROUND OF THE INVENTION

The present invention relates to a resealable label flap positionable to cover an opening in a product package containing removable articles such that the label flap can be repeatedly removed and reapplied to access the articles contained within the package. More specifically, the present invention relates to a multi-layer, resealable label flap that includes an label stop that inhibits the complete removal of the label flap from the product package.

Resealable label flaps are commonly used with product packages that include packaged sheet-like removable articles that have been thoroughly wetted with a liquid prior to packaging. The product package is generally constructed from a thin, liquid-impervious material that has an opening over which the label flap is removably adhered. Typically, the label flap is a strip of flexible or semi-rigid thermoplastic material having a removable pressure-sensitive adhesive applied to one surface of the label. The removable adhesive creates a generally air-tight seal around the package opening to prevent the packaged removable articles from drying out during storage.

Typically, resealable label flaps include one end that is more securely attached to the product package to create a "stop point" that prevents the user from completely removing the label flap from the product package. If the label flap is completely removed, the flap may be incorrectly repositioned back on the product package or may be completely lost by the user. If the label flap is incorrectly repositioned or not reapplied, the wetted removable articles contained within the product package are vulnerable to contamination and may eventually dry out, thus reducing the product's effective life.

In the field of resealable label flaps, there are several methods currently used to affix the label flap to the package body to create a stop point that inhibits the complete removal of the label flap from the package. One method, as embodied in U.S. Pat. No. 4,552,269 to Chang and U.S. Pat. No. 5,725,311 to Ponsi et al., includes the procedure of die-cutting the label flap so that upon opening, the label flap will hinge between the die-cuts and remain adhered to the package. The die-cuts create a stop point that inhibits the complete removal of the label flap from the product package. Although this method has proven effective to prevent complete removal of the label flap, the additional required step of die-cutting the label increases the complexity of the production process and requires additional equipment.

Another method used to create a stop point for the label flap is shown and described in U.S. Pat. No. 4,840,270 to Caputo et al. This method involves treating a specific area of the package body's surface with a corona discharge so that the adhesion characteristics of a treated area are improved. After the application of the pressure-sensitive label flap, the label flap can be pealed easily up to the corona-treated zone. At the corona-treated zone, the adhesion between the label flap and the package body is substantially greater, which prevents the inadvertent complete removal of the label flap from the package during opening. Although this type of method prevents the label flap from being completely removed from the product packaging, the process of corona treating the product package in a specific area increases the time required to form the package and increases the cost to produce the product package including the label flap.

Another method for creating a stop point for the label flap is described in U.S. Pat. No. 5,035,518 to McClintock. In forming a label flap using this method, two types of adhesives are applied to the back of the label. A first, resealable adhesive is applied to a substantial portion of the label, while a second, permanent adhesive is applied to a narrow strip of the label. The permanent adhesive applied to the small strip of the label creates a substantial bond with the product package to prevent the label flap from being completely removed from the product package. This method of forming a label stop suffers from several drawbacks. For example, the application of two types of adhesive material to a single label is difficult to control and the two adhesives must be of the same family, since the application equipment used to apply the adhesives is typically the same.

Therefore, it is an object of the present invention to provide a resealable label flap that includes an label stop that securely retains the label flap on the product package to prevent the label flap from being completely removed from the product packaging. It is an additional object of the invention to provide a resealable label flap that is easy to manufacture using conventional label forming machinery. It is a further object of the invention to provide a multi-layer label flap that incorporates both a permanent adhesive and a resealable adhesive to allow the label flap to be resealably attached to the product packaging while preventing complete removal of the label flap from the product packaging.

SUMMARY OF THE INVENTION

The present invention is a resealable label flap that can be positioned to cover an opening in a product package. The resealable label flap generally includes a base layer extending between a first end and a second end. The base layer includes a top face surface and a bottom face surface that define the thickness of the base layer. A first adhesive is applied over substantially the entire surface area of the bottom face surface of the base layer. The first adhesive is a removable pressure-sensitive adhesive that retains its adhesive properties following repeated removal and reapplication of the base layer to the package body. The base layer includes a starting tab formed near the second end of the base layer. The starting tab is an area of the base layer that does not adhesively attach to the package body.

The label flap further includes a top layer secured to the top face surface of the base layer. The top layer is defined by a top and bottom face surface, the bottom face surface of which includes a second adhesive applied over its entire surface area. The second adhesive functions to secure the top layer to the top face surface of the base layer. The top layer of the base layer extends between a first end and a second end. The second end of the top layer is generally aligned with the second end of the base layer, while the first end of the top layer extends past the first end of the base layer to form a label stop for the label flap.

The second adhesive applied to the bottom face surface of the top layer is a permanent adhesive having greater adhesive properties than the first adhesive applied to the base layer. The permanent adhesive applied to the top layer is also contained on the label stop such that the label stop permanently bonds with the package body when the label flap is positioned on the package body. The permanent adhesive contained on the label stop forms a stop point to prevent the label flap from being completely removed from the package body during repeated opening and closing of the label flap.

In a further version of the present invention, the top layer including the permanent second adhesive defines the label stop and extends over only a portion of the top face surface of the base layer. Additionally, in another feature of the invention, the base layer is formed form opaque material while the top layer is formed from transparent material.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 3 is a side plan view including a partial section view of the product package including the resealable label flap;

FIG. 4 is a bottom plan view of the resealable label flap of the present invention;

FIG. 5 is a section view taken along line 5—5 of FIG. 4; and

FIG. 6 is a bottom plan view of an alternate embodiment of the resealable label flap of the present invention.

DETAILED DESCRIPTION OF THE INVENTION

Figure 1:
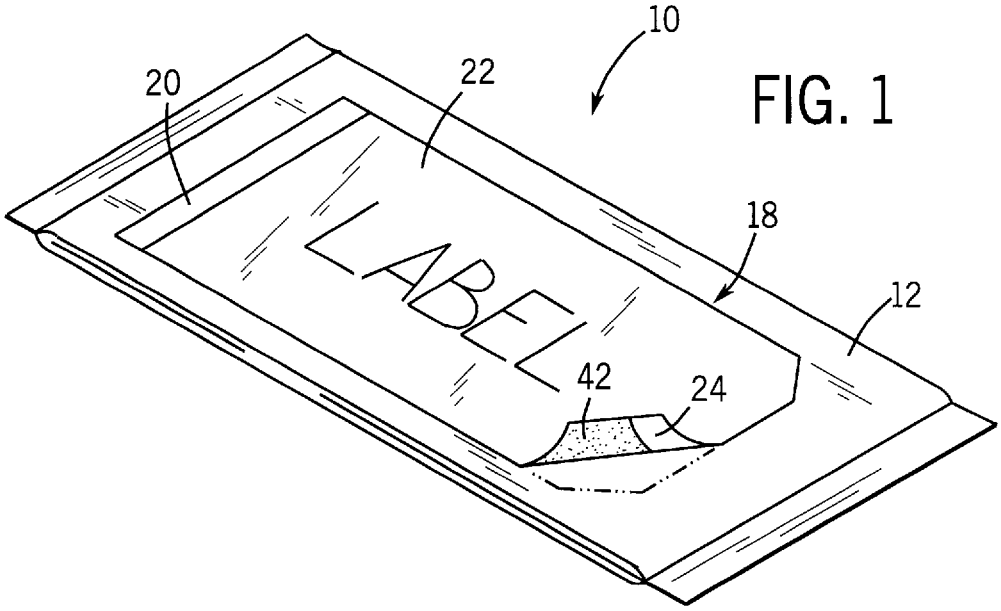
FIG. 1 is a perspective view of a resealable product package incorporating the resealable label flap of the present invention in the closed position.
Figure 2:
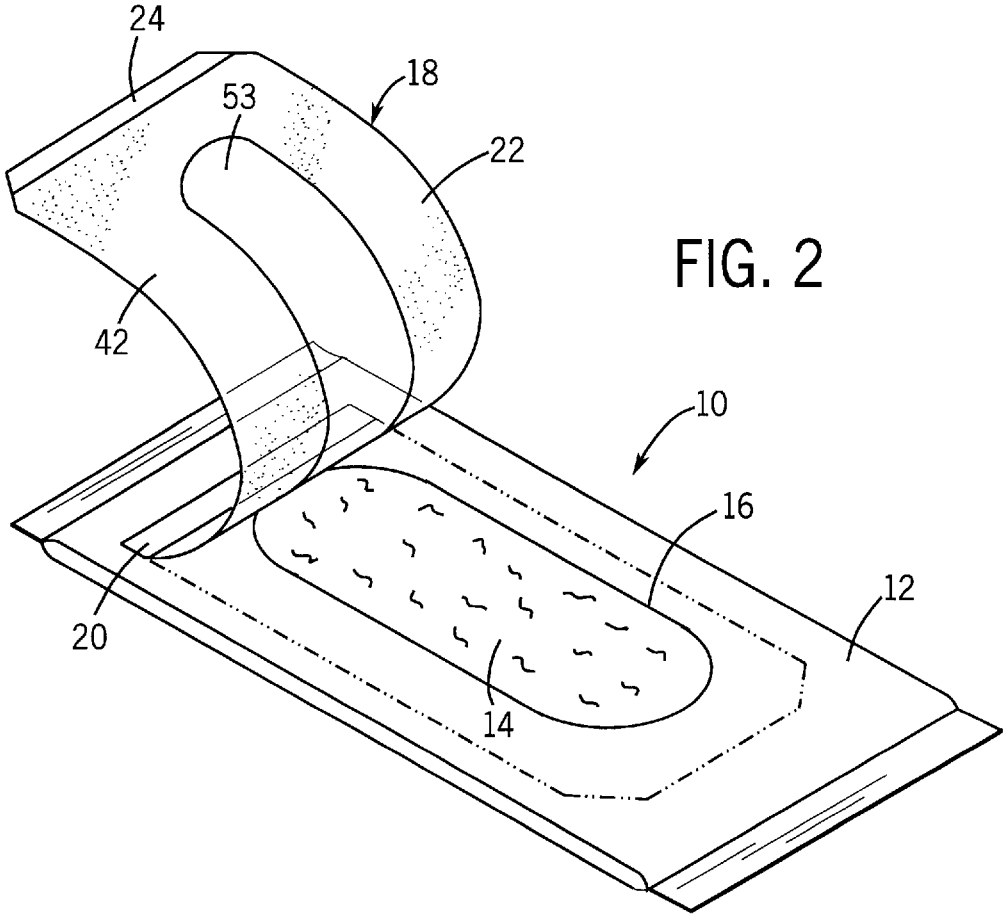
FIG. 2 is a perspective view similar to FIG. 1 illustrating the resealable label flap in the open position.

FIGS. 1–3 generally illustrate a resealable product package 10 having a main package body 12 formed from a cylinder of liquid-impervious flexible thermoplastic material heat sealed on each end to define an internal space for housing the removable articles contained within the product package 10. In the embodiment of the invention illustrated in FIGS. 1–3, the contents of the product package 10 comprise a series of stacked, individual cleansing cloths 14 that can be impregnated with appropriate cleaning solutions. For example, the cleansing cloths 14 could be wetted baby wipes or hand towels.

The package body 12 includes an opening 16 through the package body to provide access into the internal space of the package body 12 containing the cleansing cloths 14. As can be readily understood, the individual cleansing cloths 14 can be removed from the internal space defined by the package body 12 through the opening 16.

The product package 10 further includes a removable label flap 18 that is applied to the package body 12 to seal the package body by covering the opening 16. The label flap 18 contacts the generally smooth, flat top surface of the package body 12 and forms a generally water and air-tight seal with the package body 12 around the opening 16. The water and air-tight seal around the opening 16 prevents contamination of the cleansing cloths 14 and prevents the cleansing cloths 14 from drying out.

The label flap 18 is resealably attachable to the upper surface of the package body 12 such that the label flap 18 can be repeatedly opened and resealed to provide access to the cleansing cloths 14 contained within the internal space defined by the package body 12. The label flap 18 includes a label stop 20, a main body portion 22 and a starting tab 24. In general, the main body portion 22 includes a removable adhesive that allows the label flap to be repeatedly pealed from the package body 12 and reapplied thereto in order to gain access to the opening 16 and then reseal the product package 10. The resealable adhesive contained on the main body portion 22 generally retains its adhesive properties during repeated application and removal of the main body portion 22 to the package body 12.

The label stop 20 includes a permanent adhesive having much stronger adhesive properties than the removable adhesive applied to the main body portion 22. The permanent adhesive contained along the label stop 20 prevents the label stop 20 from becoming detached from the package body 12 during the removal of the label flap 18 from the package body 12. The label stop 20 serves as a functional "stop point" during pealing of the label flap 18 from the package body 12 to access the cleansing cloths 14.

The starting tab 24 is a portion of the label flap 18 in which the adhesive on the label flap 18 is rendered ineffective or, in the alternative, not present such that the starting tab 24 can be grasped by the user to pull the label flap 18 from the package body 12.

Referring now to FIGS. 4–5, the label flap 18 generally extends between an attachment end 26 and a removable end 28. The removable end 28 includes the starting tab 24, while the attachment end 26 generally includes the label stop 20.

As can best be seen in FIG. 5, the label flap 18 is a multi-layered member comprising a base layer 30 and a top layer 32 affixed to the base layer 30. The base layer 30 extends between a first end 34 and a second end 36 and has a thickness defined by a bottom face surface 38 and an opposed top face surface 40. The bottom face surface 38 of the base layer 30 includes a first adhesive 42 applied on the entire surface area of the bottom face surface 38. As shown in FIG. 5, a coating 43 is applied over the first adhesive 42 alonga portion of the bottom face surface 38 to define the starting tab 24. In an alternate embodiment, the first adhesive may not be present along the same portion of the bottom face surface 38 to define the starting tab 24.

In the preferred embodiment of the invention, the first adhesive 42 applied to the base layer 30 is a pressure-sensitive adhesive that retains its adhesive qualities as the label flap 18 is repeatedly pealed from the package body 12 and reapplied thereto. The first adhesive 42 has the desired adhesive properties to form a seal around the opening 16 while being able to be pulled from the package body 12 without damaging the thermoplastic material forming the package body 12. In the preferred embodiment of the invention, the base layer 30 including the first adhesive 42 is commercially available from Flexcon, Inc., Spencer, Mass. as Product No. PE380FWM/V-29/50KQ-8. In the embodiment shown, the base layer 30 is formed from white polyethylene having a thickness of 0.0038 inches, while the first adhesive 42 is a V-29 removable adhesive having a surface thickness of 0.0007 inches.

In the preferred embodiment of the invention, the combination of the base layer 30 and the layer of the first adhesive 42 has a range of thicknesses between 0.0005 to 0.020 inches. Preferably, the base layer 30 is opaque and of a desirable color. Additionally, graphic images, such as a product identifier, can be printed to the top face surface 40. In a contemplated alternate embodiment, the base layer 30 can be formed from either clear or translucent polymeric film while operating within the scope of the present invention.

As discussed, the label flap 18 is a multi-layer structure including a top layer 32. The top layer 32 extends between a first end 44 and a second end 46. Preferably, the second end 46 of the top layer 32 is aligned with the second end 36 of the base layer 30, such that the combination of the base layer 30 and the top layer 32 define the removable end 28 of the label flap 18.

The top layer 32 includes a top face surface 48 and a bottom face surface 50. A second adhesive 52 is applied to the entire bottom face surface 50 of the top layer 32 as shown in FIG. 5. The second adhesive 52 is a high-bond, permanent adhesive that is a much stronger adhesive compared to the first adhesive 42, which is a removable pressure-sensitive adhesive. The second adhesive 52 securely bonds the top layer 32 to the top face surface 40 of base layer 30 such that the entire label flap 18 is a monolithic member. The strong adhesive properties of the second adhesive 52 prevents separation of the top layer 32 from the base layer 30 during normal usage of the label flap 18.

As can best be seen in FIGS. 4 and 5, the first end 44 of the top layer 32 extends past the first end 34 of the base layer 30 to define the label stop 20. The label stop 20 is defined by the area of the top layer 32 including the second adhesive 52 that extends past the first end 34 of the base layer 30. In the preferred embodiment of the invention, the width of the label stop 20 is approximately 0.25 inches.

In the preferred embodiment of the invention, the top layer 32 including the second adhesive 52 is commercially available from Flexcon, Inc. of Spencer Mass. as Product No. OP100C/V-344/150 PET H-9. In the preferred embodiment, the top layer 32 is formed from clear polypropylene having a thickness of approximately 0.001 inches and the second adhesive 52 is a V-344 adhesive having a thickness of approximately 0.0008 inches. Preferably, the combination of the top layer 32 and the second adhesive 52 is transparent, such that the top face surface 40 of the base layer 30 is viewable through the top layer 32 and the second adhesive 52. Thus, if text or graphic images are printed on the top face surface 40, they are visible through the top layer 32. Additionally, the top layer 32 functions to protect the printed graphic images contained on the top face surface 40.

In an alternate embodiment of the invention, the top layer 32 could be formed from opaque or translucent materials and could in turn include printed graphic images. In the preferred embodiment of the invention, the combination of the top layer 32 and the second adhesive 52 has a thickness between 0.0005 to 0.020 inches.

When the label flap 18 is positioned on the package body 12, the removable first adhesive 42 applied to the base layer 30 is pressed into contact with the package body 12 and the base layer 30 covers the entire opening 16. At the same time, the label stop 20 extending past the first end 34 of the base layer 30 is pressed into contact with the package body 12 at a location spaced from the opening 16. Since the label stop 20 includes the permanent second adhesive 52, the label stop 20 permanently adheres to the package body 12.

When a user desires to access the cleansing cloths 14 contained within the package body 12, the user first grasps the starting tab 24 Once the starting tab 24 has been grasped, the user pulls back on the label flap 18 to overcome the removable adhesive bond between the removable first adhesive 42 and the package body 12. The user continues to pull back on the label flap 18 until the entire base layer 30 has been pulled out of contact from the package body 12.

As shown in FIG. 1, the first time the label flap 18 is pulled from the package body 12, a perforated oval covering 53 separates from the package body 12 to define the opening 16. The oval covering 53 remains adhesively attached to the label flap 18 and prevents contact between the first adhesive 42 and the cleaning cloths 14.

Once the entire base layer 30 has been pulled off of the package body 12, the permanent bond between the second adhesive 52 contained on the label stop 20 and the package body 12 prevents the entire label flap 18 from being removed from the package body 12. In this manner, the label stop 20 prevents the label flap 18 from being completely removed from the package body 12.

After the desired number of cleaning cloths 14 have been removed from the opening 16, the user repositions the label flap 18 over the opening 16. The first adhesive 42 contained on the base layer 30 reseals the label flap 18 onto the package body 12 to form the required air-tight seal around the opening 16.

The formation of the label flap 18 of the present invention will now be described. Initially, a base material comprised of the base layer 30, the first adhesive 42 and a releasable liner (not shown) is unwound. The base layer 30 including the first adhesive 42 are then separated from the releasable liner and a coating is applied to the first adhesive 42 at a location corresponding to the starting tab 24. The applied coating renders of the first adhesive 42 ineffective to form the starting tab 24. With the starting tab 24 formed, the releasable liner is again reapplied to the base layer 30 including the first adhesive 42.

After the starting tab 24 has been formed, a graphic image can be printed on the top face surface 40 of the base layer 30 if desired. After printing, the base layer 30 including the first adhesive 42 is kiss-cut into the desired shape and the surrounding matrix removed.

Once the shape of the base layer 30 is set, the top layer 32 including the second adhesive 52 are applied to the top face surface 40 of the base layer 30. Once the top layer 32 has been applied to the base layer 30, the final shape of the label flap 18 is die-cut such that a portion of the top layer 32 extends past the first end 34 of the base layer 30 to define the label stop 20. Once the label flap 18 has been formed, it can be applied to the package body 12 to cover the opening 16 as previously discussed.

Although the present invention has been defined as including a top layer 32 that cover the entire top face surface 40 of the base layer 30, an alternate embodiment of the invention is shown in FIG. 6. In this embodiment, the top layer 32 terminates at a second end 54 that is spaced from the second end 36 of the base layer 30. In this embodiment, top layer 32 does not cover the entire top face surface 40 of the base layer 30 but simply covers a small portion of the top face surface 40. The top layer 32 of the second embodiment still extends past the first end 34 of the base layer 30 to define the label stop 20 in an identical manner as discussed above.

Although the present invention has been defined as including specific types of adhesives for both the first adhesive 42 and the second adhesive 52, it should be understood that a critical feature of the invention is that the first adhesive 42 be a pressure-sensitive, removable adhesive to permit the label flap 18 to be repeatedly removed and reapplied to the package body 12, while the second adhesive 52 is a permanent adhesive that prevents the label flap 18 from being completely removed from the package body 12. The dual layer construction of the label flap 18 allows two distinct types of adhesive layers to be utilized without difficult and time-consuming applications of the separate adhesives.

Various alternatives and embodiments are contemplated as being within the scope of the following claims particularly pointing out and distinctly claiming the subject matter regarded as the invention.

We claim:

1. A resealable label flap positionable to cover an opening in a package containing removable articles, the label flap comprising:

a base layer extending between a first end and a second end, the base layer including a first adhesive that permits repeated application and removal of the base layer from the package; and a top layer affixed to the base layer, the top layer including a label stop extending past the first end of the base layer, the label stop including a second adhesive having greater adhesion than the first adhesive to prevent removal of the label from the package.

2. The resealable label flap of claim 1 wherein the second adhesive is a permanent adhesive that forms a permanent bond to the package.

3. The resealable label flap of claim 1 wherein the top layer completely covers the base layer.

4. A resealable label flap positionable to cover an opening in a package containing removable articles, the label flap comprising:

a base layer extending between a first end and a second end, the base layer having a bottom face surface positionable in contact with the package and an opposed top face surface, the bottom face surface including a first adhesive applied thereto that permits repeated application and removal of the base layer from the package; and a top layer having a bottom face surface affixed to the top face surface of the base layer, the bottom face surface of the top layer including a second adhesive applied thereto having greater adhesion than the first adhesive applied to the bottom face surface of the base layer, the top layer extending past the first end of the base layer to form a label stop, the label stop being positionable in contact with the package such that the second adhesive on the label stop prevents removal of the label from the package.

5. The resealable label flap of claim 4 wherein the base layer includes a starting tab contained on the second end of the base layer, the starting tab being devoid of the first adhesive.

6. The resealable label flap of claim 4 wherein the first adhesive is a removable adhesive and the second adhesive is a permanent adhesive.

7. The resealable label flap of claim 4 wherein the top layer is transparent.

8. The resealable label flap of claim 4 wherein the top layer completely covers the top face surface of the base layer.

9. A resealable package, comprising:

a flexible package body having an internal space sized to contain a plurality of removable articles;

an elongated opening through the package body to the internal space for accessing the removable articles;

a resealable label flap positioned on the flexible package to cover the opening in the package, the label flap comprising:

a base layer extending between a first end and a second end, the base layer having a top face surface and a bottom face surface, the bottom face surface including a first adhesive applied thereto that permits repeated application and removal of the base layer from the package body; and a top layer having a bottom face surface affixed to the top face surface of the base layer, the bottom face surface of the top layer including a second adhesive applied thereto having greater adhesion than the first adhesive applied to the bottom face surface of the base layer, the top layer extending past the first end of the base layer to form a label stop, the label stop being positionable in contact with the package such that the second adhesive on the label stop prevents removal of the label from the package.

10. The resealable package of claim 9 wherein the first adhesive is a pressure-sensitive, removable adhesive and the second adhesive is a permanent adhesive.

11. The resealable package of claim 9 wherein the top layer completely covers the top face surface of the base layer.

12. The resealable package of claim 9 wherein the label flap includes a starting tab positioned near the second end of the base layer.

* * * * *